United States Patent [19]

Lonnemo

[11] Patent Number: 4,480,527

[45] Date of Patent: Nov. 6, 1984

[54] POWER TRANSMISSION

[75] Inventor: Kurt R. Lonnemo, Bloomfield Hills, Mich.

[73] Assignee: Vickers, Incorporated, Troy, Mich.

[21] Appl. No.: 349,554

[22] Filed: Feb. 17, 1982

Related U.S. Application Data

[63] Continuation of Ser. No. 117,936, Feb. 4, 1980, abandoned.

[51] Int. Cl.[3] ..... F15B 11/08; F15B 13/042

[52] U.S. Cl. ..... 91/436; 91/438; 91/446; 91/454; 137/596.15

[58] Field of Search ..... 91/436, 446, 454, 457, 91/464, 437, 438, 439; 137/596.14, 596.15, 596.16

[56] References Cited

U.S. PATENT DOCUMENTS

| | | | |
|---|---|---|---|
| 3,782,250 | 1/1974 | Kiszewski | 91/454 X |
| 3,800,670 | 4/1974 | Hufeld et al. | 91/454 X |
| 4,200,118 | 4/1980 | Budzich | 91/436 X |
| 4,201,052 | 5/1980 | Breeden et al. | 60/445 |
| 4,250,794 | 2/1981 | Haak et al. | 91/420 |

*Primary Examiner*—Irwin C. Cohen

*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions and a variable displacement pump with loading sensing control for supplying fluid to said actuator. A pair of meter-in valves are provided to which the fluid from the pump is supplied and a pilot controller alternately supplies fluid at pilot pressure to a meter-in valve for controlling the displacement of movement of the meter-in valve and the direction and velocity of the actuator. Alternately pilot pressure from the pilot controller is applied simultaneously to both of the meter-in valves in conjunction with the venting of one of two load drop check valves to provide a regenerative mode.

A line extends from the meter-in valve to its respective opening of the actuator and a meter-out valve is associated with each line of the actuator for controlling the flow out of the actuator when that line to the actuator does not have pressure fluid from the pump applied thereto. Each meter-out valve is pilot operated by the pilot pressure from the controller.

In a modified form, utilizing a single actuator, the hydraulic control system includes a single meter-in valve associated with one opening of the actuator.

8 Claims, 8 Drawing Figures

36
73
64
32
34
61
72
62
63
65
160
71
41
72a
67
70
28

POWER TRANSMISSION

This application is a continuation of application Ser. No. 117,936, filed Feb. 4, 1980, now abandoned.

This invention relates to power transmission and particularly to hydraulic circuits for actuators such as are found in earth moving equipment including excavators and cranes.

BACKGROUND AND SUMMARY OF THE INVENTION

This invention relates to hydraulic systems for controlling a plurality of actuators such as hydraulic cylinders which are found, for example, in earth moving equipment such as excavators and cranes. In such a system, it is conventional to provide a pilot operated control valve for each actuator which is controlled by a manually operated controller through a pilot hydraulic circuit. The control valve functions to supply hydraulic fluid to the actuator to control the speed and direction of operation of the actuator. In addition, the control valve for each actuator controls the flow of hydraulic fluid out of the actuator. It is also common to provide counterbalance valves or fixed restrictions to control overrunning loads.

In the copending U.S. application of Robert H. Breeden et al, Ser. No. 024,058, filed Mar. 26, 1979, now U.S. Pat. No. 4,201,052, having a common assignee with the present application, there is disclosed and claimed a hydraulic system for accurately controlling the position and speed of operation of the actuators; which system is simple and easy to make and maintain; which system is unaffected by change of load pressure of various portions of the system or other actuators served by the same source; which system may not use flow from the pressure source in the case of overrunning loads on the actuators; wherein the control valves may be mounted adjacent the actuator for preventing loss of control of the load in case of malfunction in the hydraulic lines to the actuator; wherein the valves which control flow out of the actuator function to control the velocity in the case of energy generating loads, wherein the valve that controls flow into the actuator controls the velocity in the case of energy absorbing loads; wherein the valve system for each actuator can be mounted on its respective actuator and incorporates means for preventing uncontrolled lowering of the load in case of pressure failure due to breaking of the lines to the valve system; wherein the timing of operation of the valve controlling flow into the actuator and out of the actuator can be designed to accommodate the specific nature of the particular load.

It is an object of the present invention to provide a dual acting hydraulic control system having dual meter-in valves for controlling dual-acting hydraulic actuators.

Another object of the present invention is to provide a dual acting hydraulic control system having dual meter-in valves for providing control of dual-acting hydraulic actuators in a regenerative mode.

A further object of the present invention is to provide a single acting hydraulic control system for controlling single acting hydraulic actuators.

The present invention comprises a hydraulic control system for use with a hydraulic actuator, a pilot controller, and a pump. The actuator includes a movable element and a pair of openings adapted to function alternately as inlets or outlets for moving the element in opposite directions. The pilot controller supplies fluid to the system at pilot pressure and the pump supplies fluid at pump pressure to the actuator. The control system includes a line adapted for connection to each of the openings and a meter-out valve associated with each of the lines for controlling fluid flow from the actuator. The meter-out valves are each selectively pilot operated by pilot pressure from the pilot controller. A meter-in valve is positioned in each of the lines for controlling fluid flow from the pump to the actuator with each of the meter-in valves being selectively operable by pilot pressure from the pilot controller.

In one embodiment of the present invention the actuator includes a head end and a rod end associated with each of the pair of openings and each of the lines adapted to be connected therewith having a load drop check valve associated with the head end and rod end, respectively. A means for venting the load drop check valve associated with the rod end and means for simultaneously opening the meter-in valves provide control of fluid flow to the actuator in a regenerative mode.

Another embodiment of the invention comprises a hydraulic control system for use with a hydraulic actuator having a movable element and an opening adapted to function alternately as an outlet and an inlet for moving the element. A pilot controller controls a supply of fluid at pilot pressure and a pump supplies fluid at pump pressure to the actuator. The hydraulic control system comprising a single line adapted for connection to the opening of the actuator and a single meter-out valve associated with the line for controlling flow from the opening. The meter-out valve being pilot operated by pilot pressure from the pilot controller. A single meter-in valve is positioned in the line for controlling fluid flow from the pump to the actuator with the meter-in valve being operable by pilot pressure from the pilot controller.

These and other objects, advantages, and details of the invention may be had from the following drawings and description taken together with the accompanying claims.

DETAILED DESCRIPTION

Figure 1:
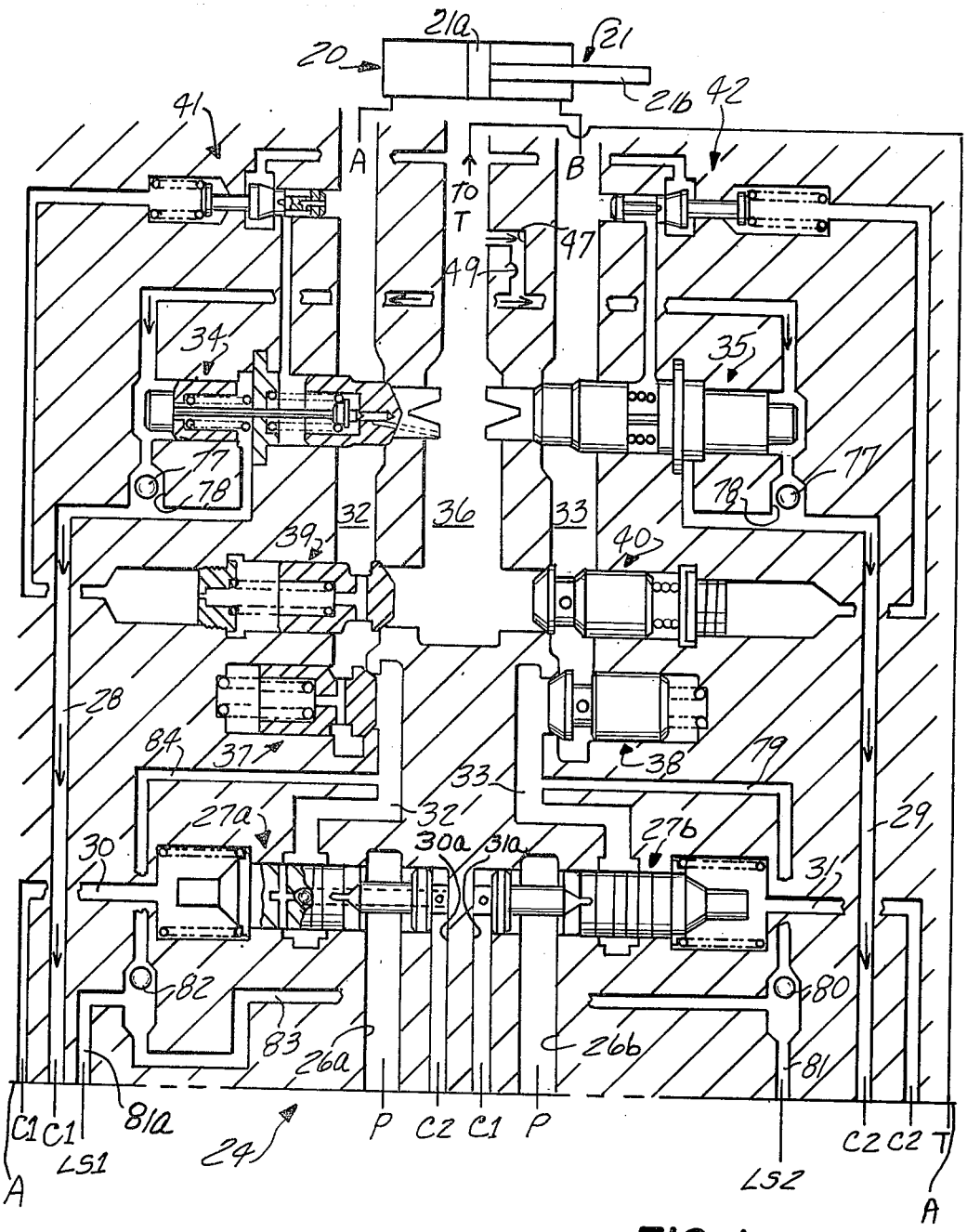
FIG. 1 is a diagrammatic view of a hydraulic control system embodying the invention.
Figure 1A:
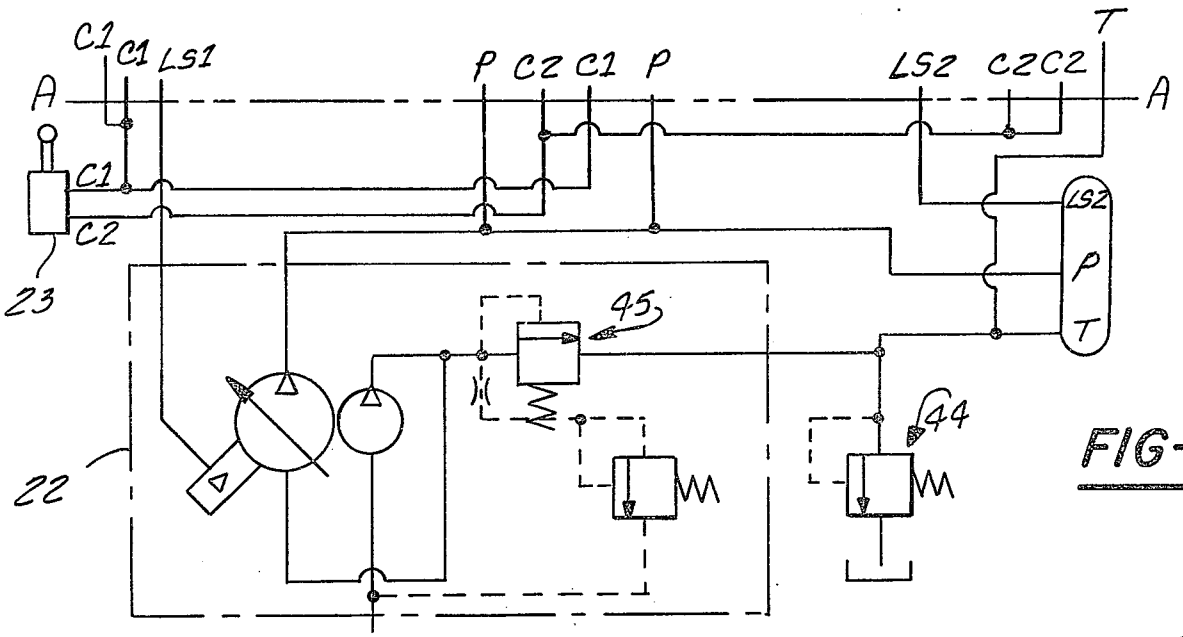
FIG. 1*a* is a diagrammatic view of a control circuit used in conjunction with FIG. 1 along line A—A.

Referring to FIG. 1 and FIG. 1*a*, the hydraulic system embodying the invention comprises an actuator 20, herein shown as a hydraulic cylinder having a movable rod 21, a head end 21*a*, a rod end 21*b*, and a pair of openings A and B associated with head end 21*a* and rod end 21*b*, respectively. Rod 21 is moved in opposite directions by hydraulic fluid supplied from a variable displacement pump system 22, FIG. 1*a*, which has load sensing control in accordance with conventional construction. The hydraulic system further includes a manually operated controller 23 that directs a pilot pressure to a valve system 24 for controlling the direction of movement of the actuator, as presently described. Fluid from the pump 22 is directed to the pump pressure lines P and passages 26 and 26*a* to a pair of meter-in valves 27*a*, 27*b*, that function to direct and control the flow of hydraulic fluid to one or the other end 21*a*, 21*b*, of the actuator 20. Each meter-in valve 27*a*, 27*b* is pilot pressure controlled by controller 23 movable to direct pilot pressure through lines C1 or C2 to passages 28 or 29 and passages 30*a* or 31*a* to one or the other of the meter-in valves. Depending upon which of the meter-in valves is actuated, hydraulic fluid passes through passages, 32, 33 to one or the other end of the actuator 20.

The hydraulic system further includes a meter-out valve 34, 35 associated with each end of the actuator in passages 32, 33 for controlling the flow of fluid from the end of the actuator to which hydraulic fluid is not flowing from the pump to a tank passage 36, as presently described.

The hydraulic system further includes spring loaded poppet valves 37, 38 in the lines 32, 33 and spring loaded anti-cavitation valves 39, 40 which are adapted to open the lines 32, 33 to the tank passage 36. In addition, spring loaded poppet valves 41,42 are associated with each meter-out valves 34, 35 as presently described. A bleed line 47 having an orifice 49 extends from passage 36 to meter-out valves 34, 35 and to the pilot control lines 28, 29 through check valves 77.

The system also includes a back pressure valve 44, FIG. 1*a*, associated with the return or tank line. Back pressure valve 44 functions to minimize cavitation when an over-running or a lowering load tends to drive the actuator down. A charge pump relief valve 45 is provided to take excess flow above the inlet requirements of the pump 22 and apply it to the back pressure valve 44 to augment the fluid available to the actuator.

Figure 2:
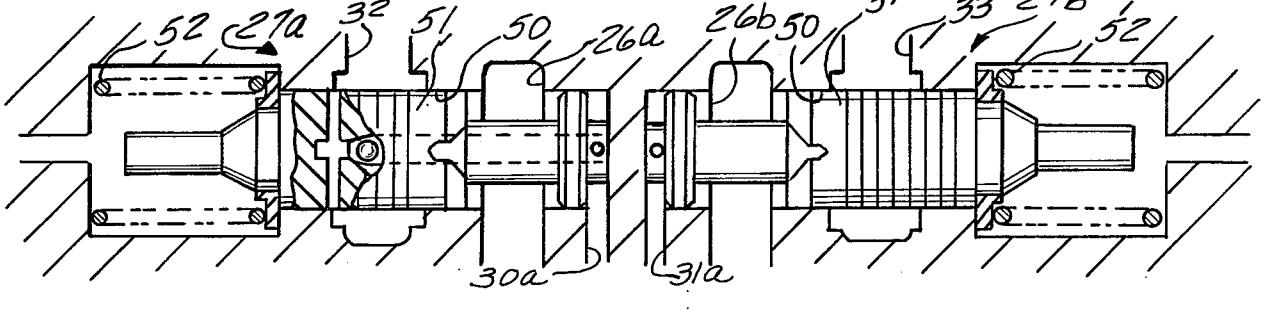
FIG. 2 is a diagrammatic view of meter-in valves utilized in the hydraulic control system of FIG. 1.

Referring to FIG. 2, each meter-in valve 27*a*, 27*b* comprises a bore 50 in which a spool 51 is positioned and in the absence of pilot pressure maintained in a neutral position by springs 52. The spool 51 normally blocks the flow from the pressure passages 26*a*, 26*b* to the passages 32, 33. When pilot pressure is applied to either passages 30*a* or 31*a*, the meter-in spool 51 of the respective meter-in valve is moved in the direction of the pressure until a force balance exists among the pilot pressure, the spring load and the flow forces. The direction of movement determines which of the passages 32, 33 is provided with fluid under pressure from passage 26*a* or 26*b*.

Figure 4:
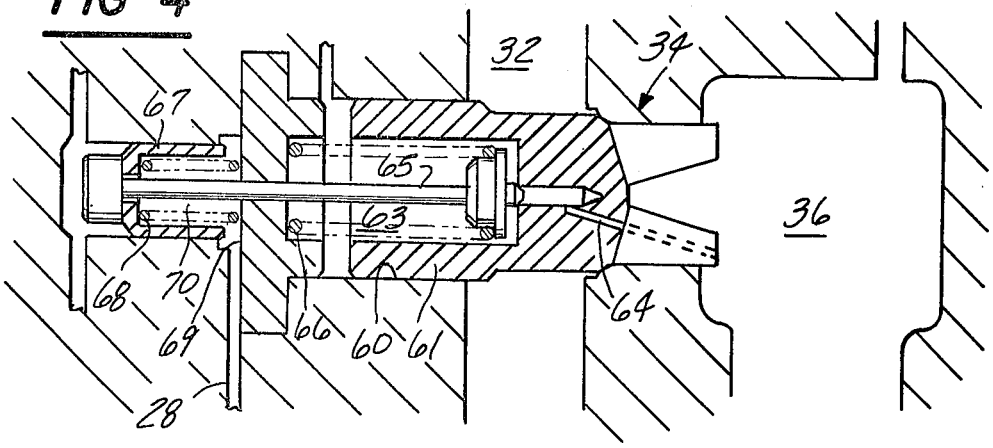
FIG. 4 is a diagrammatic view of a meter-out valve utilized in the hydraulic control system of FIG. 1.

Referring to FIG. 4, each meter-out valve 34, 35 is of identical construction and, for purposes of clarity, only valve 34 is described. The meter-out valve 34 includes a bore 60 in which a poppet 61 is positioned. The poppet 61 includes one or more passages 64 extending from an area 63 within the poppet to the tank passage 36. A stem 65 normally closes the connection between the chamber 63 and passages 64 under the action of a spring 66. The pressure in area or chamber 63 equalizes with the pressure in line 32 and the resulting force unbalance keeps poppet 61 seated. The valve further includes a piston 67 surrounding the stem 65 yieldingly urged by a spring 68 to the left as viewed in FIG. 4. The pilot line 28 from the controller 23 extends through a passage 69 to a chamber 70 that acts against the piston 67. When pilot pressure is applied to passage 28, the piston 67 is moved to the left as viewed in FIG. 4 moving the stem 65 to the left permitting chamber 63 to be vented to tank passage 36 via passage 64. The resulting force unbalance causes poppet 61 to move to the left connecting line 32 to passage 36.

It can thus be seen that the same pilot pressure which functions to determine the direction of opening of a meter-in valve also functions to determine and control the opening of the appropriate meter-out valve so that the fluid in the actuator can return to the tank line.

Figure 3:
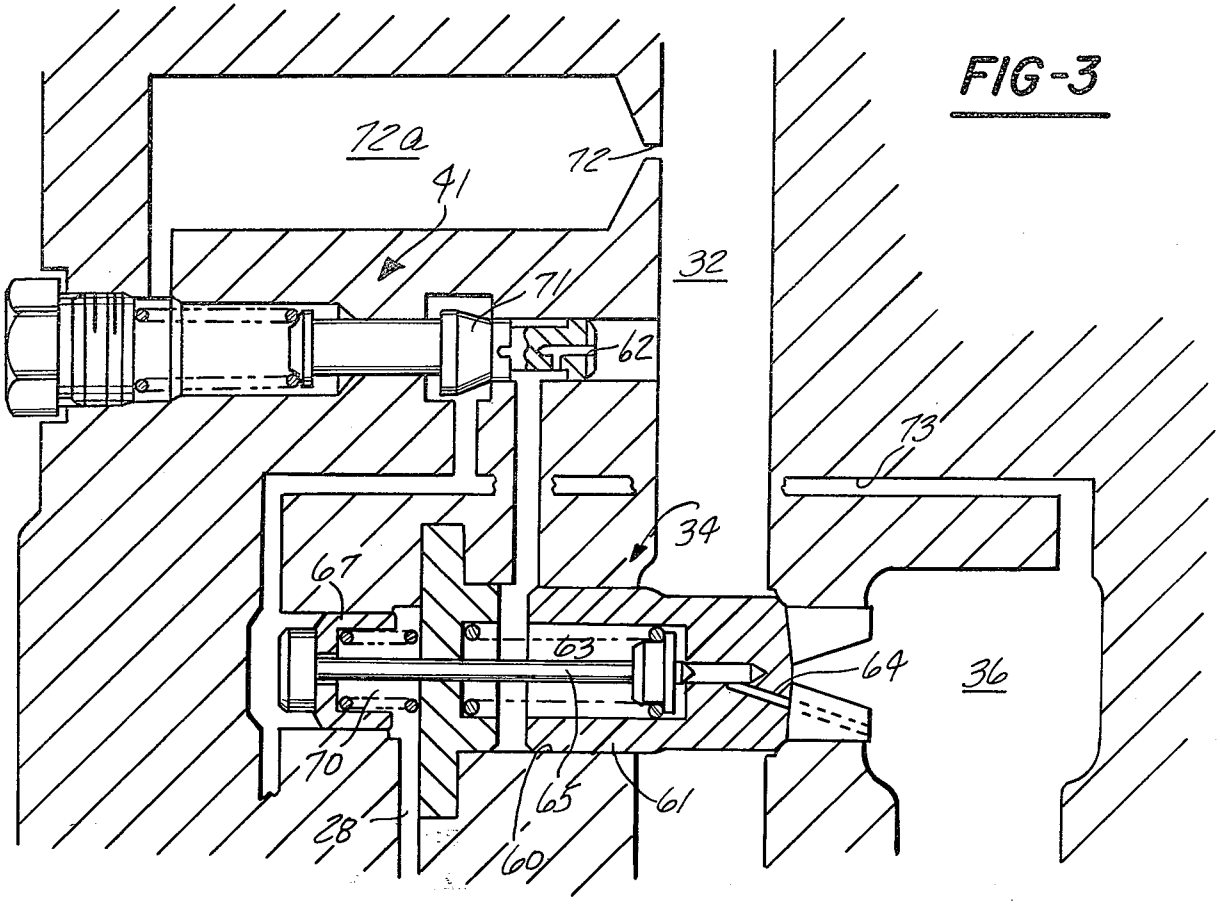
FIG. 3 is a diagrammatic view of a relief valve and meter-out valve utilized in the hydraulic control system of FIG. 1.

Referring to FIG. 3, each of the meter-out valves has associated therewith a spring loaded pilot spool 71 which functions when the load pressure in passage 32 exceeds a predetermined value to open a flow path from the load through a control orifice 62 to the tank passage 36 through an intermediate passage 73. This bleed flow reduces the pressure and closing force on the left end of the poppet valve 61 permitting the valve 61 to move to the left and allowing flow from passage 32 to the return or tank line 36. In order to prevent overshoot when the pressure rises rapidly, an orifice 72 and associated chamber 72*a* are provided so that there is a delay in the pressure build-up to the left of poppet valve 71. As a result, poppet valves 71 and 61 will open sooner and thereby control the rate of pressure rise and minimize overshoot.

Referring to FIGS. 1 and 1*a*, in the case of an energy absorbing load, when the controller 23 is moved to operate the actuator 20 in a predetermined direction, pilot pressure applied through line 28 and passages, 31*a* moves the spool of the respective meter-in valve to the right causing hydraulic fluid under pressure to flow through passage 33 opening poppet valve 38 and continuing to opening B associated with rod end 21*b* of actuator 20. The same pilot pressure is applied to the meter-out valve 34 permitting the flow of fluid out of opening A associated with head end 21*a* of the actuator 20 to the return or tank passage 36.

Referring to FIGS. 1 and 1*a*, when the controller 23 is moved to operate the actuator, for example, for an overrunning or lowering a load, the controller 23 is moved to C1 so that pilot pressure is applied to passage 31*a* and to passage 28. The meter-out valve 34 opens before the respective meter-in valve 27*a* under the influence of pilot pressure. The load on the actuator forces hydraulic fluid through the opening A of the actuator past the meter-out valve 34 to the return or tank passage 36. At the same time, the poppet valve 40 is opened permitting return of some of the fluid to the other end of the actuator through opening B thereby avoiding cavitation. Thus, the fluid is supplied to the other end of the actuator without opening the meter-in valve 27*b* and without utilizing fluid from the pump.

To achieve a float position, the controller 23 is bypassed and pilot pressure is applied to both pilot pressure lines 28, 29. This is achieved, for example, by the use of solenoid operated valves which bypass controller 23 when energized and apply the fluid from pilot pump directly to lines 28, 29 causing both meter-out valves 34 and 35 to open and thereby permit both ends of the actuator to be connected to tank pressure. In this situation, the meter-out valves function in a manner that the stem of each is fully shifted permitting fluid to flow back and forth between opposed ends of the cylinder.

Figure 1B:
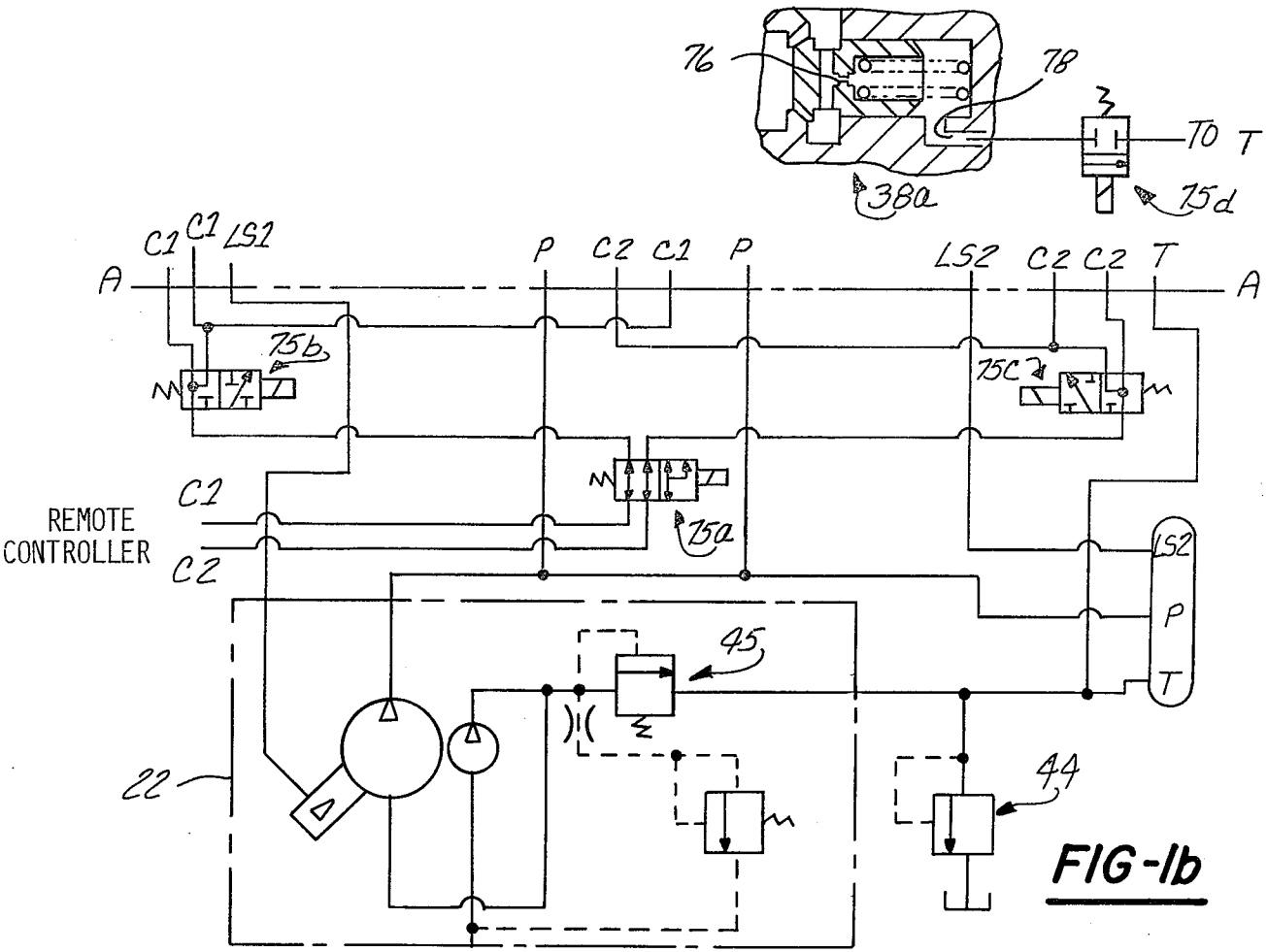
FIG. 1*b* is a diagrammatic view of another control circuit used in conjunction with FIG. 1 along line A—A.

In the modified form of the hydraulic system shown in FIG. 1*b* taken in conjunction with FIG. 1, a remote controlled circuit is provided wherein the system may be operated in the normal fashion as described above with reference to FIGS. 1 and 1*a* or in a regenerative mode as presently described. In the regenerative mode fluid from the rod end 21*b* of actuator 20 is permitted to flow to the head end 21*a* via line 33, vented load drop check valve 38*a*, presently described, meter-in valve 27*b*, and to pump pressure lines P wherein the fluid flow from rod end 21*b* joins fluid flow from the pump to head end 21*a*.

In the modified circuit three remote controlled two-position valves, such as solenoid operated valves, are provided to control the flow of pilot pressure to meter-in valves 27*a*, 27*b* and meter-out valves 34, 35, shown in FIG. 1. In addition a fourth remote controlled two-position valve is provided to vent a modified load drop check valve 38*a*, FIG. 1*b*., as described below.

A first of the two-position valves 75*a*, is connected to a remote hydraulic pilot controller through lines C1, C2 which provide fluid flow at pilot pressure thereto. First valve 75*a* is connected to a second valve 75*b* and a third valve 75*c* of the two-position valves through control pressure lines C1 and C2, respectively. Second and third valves 75*b*, 75*c* are in turn connected through lines C1 and C2 to passages 28, 30, 30*a* and 29, 31, 31*a*, respectively, of the hydraulic control system of FIG. 1. The fourth two-position or on-off valve 75*d* is connected between check valve 38*a* and tank.

The modified load check valve 38*a*, FIG. 1*b*, includes an orifice 76 and a passage 78 connected to on-off valve 75*d*. The orifice 76 provides a means of limiting the amount of flow being vented to the tank.

In normal operation on-off valve 75*d*, is closed in the spring offset position and valves 75*a*, 75*b*, and 75*c* are also in the spring offset position permitting control pressure flow in the manner heretofore described with regard to the arrangement of FIGS. 1 and 1*a*.

When a regenerative function is desired valves 75*a*, 75*b*, 75*c* and 75*d* are energized. On-off valve 75*d* vents load drop check valve 38*a* to tank, control pressure to both meter-out valves 34, 35, FIG. 1, is shut-off, and at the same time control pressure applied simultaneously opens both meter-in valves 27*a* and 27*b*. The opening of check valve 38*a* and meter-in valves 27*a* and 27*b* with meter-out valve 34 and 35 being closed permit fluid flow in the regenerative mode as described above. Thus, this circuit arrangement permits operation in the normal mode or in the regenerative mode, the latter being used where a more rapid movement of the actuator element 21 is desired.

Where the pressure in the return from end A of the actuator is excessive, the pilot spool 71 functions to permit the poppet valve 61 to open and thereby compensate for the increased pressure as well as permit additional flow to the actuator 20 through opening of the poppet valve 40 extending to the passage which extends to the other end of the actuator.

By varying the spring forces and the areas on the meter-in valves 27*a*, 27*b* and the meter-out valves 34, 35, the timing between these valves can be controlled. Thus, for example, if the timing is adjusted so that the meter-out valve leads the meter-in valve, the respective meter-in valve will control flow and speed in the case where the actuator is being driven. In such an arrangement with an overhauling load, the load-generated pressure will result in the meter-out valve controlling flow and speed. In such a situation, the anti-cavitation check valves 39, 40 will permit fluid to flow to the supply side of the actuator so that no pump flow is needed to fill the actuator in an overhauling load mode or condition.

With this knowledge of independent control of the meter-out and meter-in valves, varying metering arrangements can be made to accommodate the type of loading situation encountered by the particular actuator. Thus, where there are primarily energy absorbing or driving loads, the spring and areas of the meter-out valve can be controlled so that the meter-out valve opens quickly before the meter-in valve opens. In the case of primarily overrunning loads, the meter-out valve can be caused to open gradually but much sooner than the meter-in valve so that the meter-out valve is the primary control.

As shown in FIGS. 1 and 1*a*, a check valve 77 is provided in a branch 78 of each pilot line 28, 29 adjacent each meter-out valve 34, 35. The valves 77 allow fluid to bleed from the high tank pressure in passage 36, which fluid is relatively warm, and to circulate through pilot lines 28, 29 back to the controller 23 and the fluid reservoir when no pilot pressure is applied to the pilot lines 28, 29. When pilot pressure is applied to a pilot line, the respective check valve 77 closes isolating the pilot pressure from the tank pressure.

As further shown in FIGS. 1 and 1*a*, provision is made for sensing the maximum load pressure in one of a series of valve systems 24 controlling a plurality of actuators and applying that higher pressure to the load sensitive variable displacement pump 22. Each valve system 24 includes a line 79 extending to a shuttle valve 80 that receives load pressure from an adjacent actuator through line 81. Shuttle valve 80 senses which of the two pressures is greater and shifts to apply the same to a shuttle valve 82 through line 83. A line 84 extends from passage 32 to shuttle valve 82. Shuttle valve 82 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The provision of the load sensing system and the two load drop check valves 37, 38 provide for venting of the meter-in valves in neutral so that no orifices are required in the load sensing lines which would result in a horsepower loss during operation which would permit flow from the load during build up of pressure in the sensing lines. In addition, there will be no cylinder drift if other actuators are in operation. Further, the load drop check valves 37, 38 eliminate the need for close tolerances between the spool 51 and the bore 50.

In practice, the various components of valve assembly 24 are preferably made as a part of a valve which is mounted directly on actuator 20 so that the need for long flow lines from the valve assembly to the actuator is obviated.

Although the system has been described in connection with a variable displacement pump with load sensing control, the system can also be utilized with a fixed displacement pump having a load sensing variable relief valve. In such an arrangement, the pressure from line 81*a* is applied to the variable relief valve associated with the fixed displacement pump rather than the variable displacement pump with load sensing control. It will be apparent to those skilled in the art that many changes may be made to the described invention without departing from the spirit and scope thereof and of the appended claims.

Figure 5:
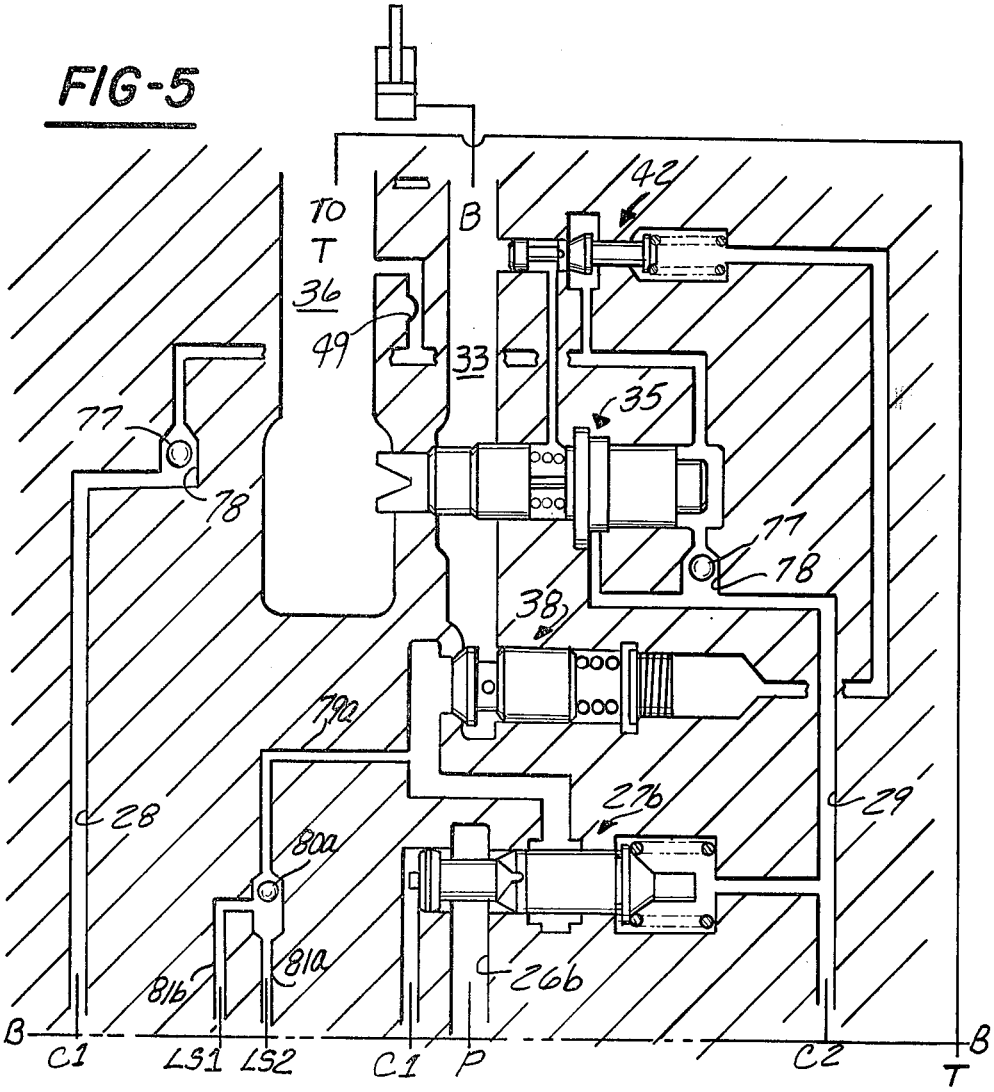
FIG. 5 is a diagrammatic view of another embodiment of the hydraulic control system of the invention.
Figure 5A:
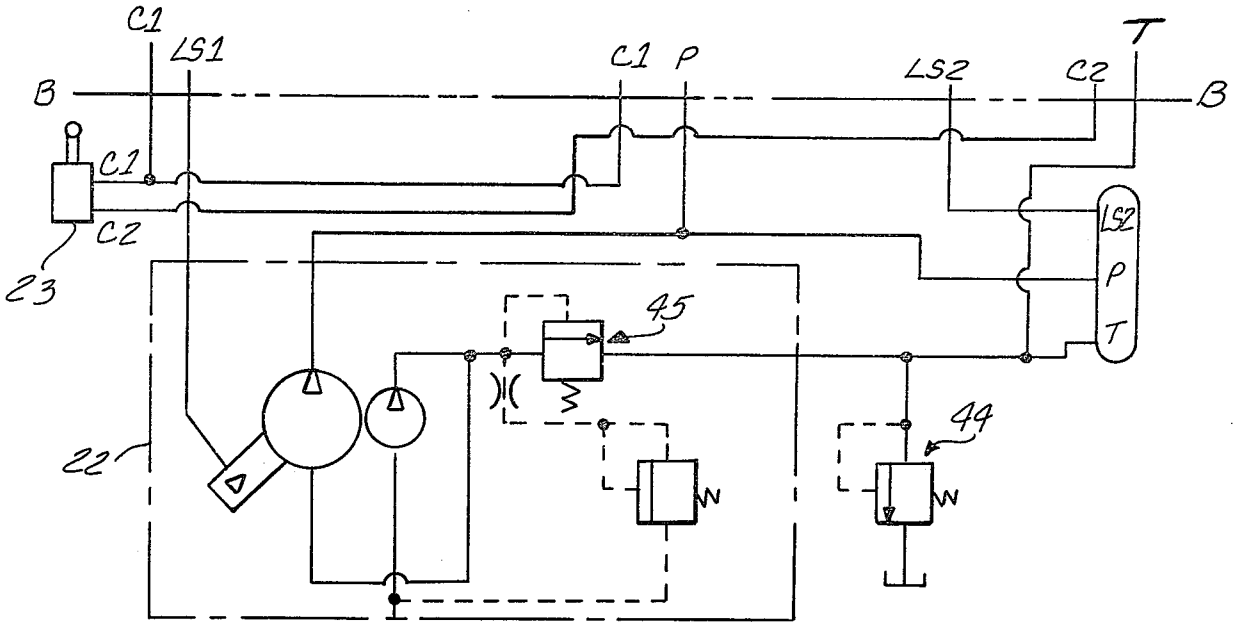
FIG. 5*a* is a diagrammatic view of a control circuit used in conjunction with FIG. 5 along line B—B.

An example of such changes is in the form of the invention shown in FIGS. 5 and 5*a*. The hydraulic control system of FIG. 1 is modified for use with a single acting hydraulic actuator 20*a* shown as a hydraulic cylinder having a rod 21*a*. Rod 21*a* is moved only in one direction by hydraulic fluid supplied from pump system 22, FIG. 5*a*, and may be moved in the opposite direction mechanically or by gravity.

In the modified single acting hydraulic system, as shown, only the elements of the right half of the double acting system shown in FIG. 1 are utilized to control actuator 20*a*.

In the case of an energy absorbing load, when controller 23, FIG. 5*a*, is moved to operate the actuator 20*a*, the controller 23 is moved to C1 so that the pilot pressure is applied through passage 28 and passage 31*a*. The applied pilot pressure moves the spool of the meter-in valve 27*b* to the right, as viewed in FIG. 5, causing hydraulic fluid under pressure to flow through passage 33 opening poppet valve 38 and continuing to inlet B of actuator 20*a*.

When the controller 23 is moved to operate the actuator for a lowering load, the controller is moved to C2 so that pilot pressure is applied to passage 29 and the meter-out valve 35 opens. The load on the actuator forces hydraulic fluid through opening B past the meter-out valve 35 to tank passage 36.

When large actuators are required, for example, in large fork lift trucks and off-highway equipment having a large double acting cylinder and high area ratios exist, an appropriately sized large volume single acting system may be used to control the head end of the cylinder and an appropriately sized small volume single acting system may be used to control the rod end of the cylinder.

When, in the interest of safety, an absolute load lock is required and no piping is allowed between the head end and the rod end of a cylinder subject to overrunning loads in both directions, a pair of single acting systems may be placed at each end of the cylinder.

What is claimed is:

1. A hydraulic control system for use with a hydraulic actuator having a movable actuator element and a pair of actuator openings adapted to function alternately as inlets and outlets for moving the actuator element in opposite directions, a pilot controller for controlling a supply of fluid at pilot pressure, a reservoir tank, and a pump for supplying fluid from the tank at pump pressure to the actuator openings, the system comprising:

a supply line adapted for connection with each of the actuator openings and the pump;

a tank line adapted for connection with a tank;

a meter-out valve interposed between each of said supply lines and said tank line for metering fluid flow between said supply and tank lines, each of said meter-out valves being selectively pilot operated by pilot pressure;

a pair of meter-in valves each positioned in one of said supply lines, said meter-in valves adapted for metering fluid flow through one or both of said supply lines, each of said meter-in valves being operable independently of the other by pilot pressure;

a load-drop check valve in each of said supply lines in series relationship with said meter-in valves, each said load drop check valve including a chamber means with fluid therein acting to close the valve; and means for simultaneously opening both of said meter-in valves, said means for simultaneously opening said meter-in valves including means for venting the chamber of one of said load-drop check valves to effect the opening thereof whereby the said supply lines communicate with one another.

2. The system of claim 1 wherein said means for venting said one load-drop check valve includes a remote controlled on-off valve connected to said one load-drop check valve, said on-off valve having an ON position wherein bleed flow from said load-drop check valve is vented to said tank line.

3. The system of claim 2 wherein each of said meter-in valves is associated with the meter-out valve in the other of said supply lines and wherein said means for simultaneously opening said meter-in valves includes three remote controlled two-position valves, said two-position valves being operable to a first position wherein pilot pressure is selectively applied to one or the other of said meter-in valves and to the meter-out valve associated therewith, and to a second position wherein pilot pressure is applied simultaneously to both of said meter-in valves and is shut-off to both of said meter-out valves.

4. The system of claim 3 wherein with said two-position valves in said second position and said on-off valve in said ON position, fluid is adapted to flow from one of the actuator openings through one of said supply lines, through both of said meter-in valves and return through the other of said supply lines to the other of the actuator openings.

5. The system of claim 1 including a hydraulic actuator having a movable actuator element, a head end, a rod end, and a pair of openings, one opening being associated with the head end and the other opening being associated with the rod end, respectively, and adapted to function alternately as inlets and outlets for moving the actuator element in opposite directions, a pilot controller for controlling a supply of fluid at pilot pressure, a tank reservoir and a pump for supplying fluid from the tank at pump pressure to the actuator, said means for venting the load-drop check valve in the supply line being associated with the rod end of the actuator.

6. The system of claim 5 wherein said means for venting said load-drop check valve includes a remote controlled on-off valve connected to said load-drop check valve, said on-off valve having an ON position wherein a bleed flow from said load-drop check valve is vented to tank.

7. The system of claim 6 wherein said means for simulftaneously opening said meter-in valves includes three remote controlled two-position valves, said two-position valves being operable to a first position wherein pilot pressure is applied selectively to one or the other of said meter-out and said meter-in valves, and to a second position wherein pilot pressure is applied simultaneously to both of said meter-in valves and is shut off to both of said meter-out valves.

8. The system of claim 7 wherein said two-position valves include a first valve, a second and a third valve, said first valve selectively controlling pilot pressure in a first position to said second or third valves and in a second position applying pilot pressure simultaneously to both of said second and third valves, and with said on-off valve in said ON position fluid is adapted to flow from the actuator opening associated with the rod end through one of said supply lines through both of the meter-in valves to the other of said supply lines to the actuator opening associated with the head end of the actuator.

* * * * *